US008627670B2

(12) United States Patent
Moraes et al.

(10) Patent No.: US 8,627,670 B2
(45) Date of Patent: Jan. 14, 2014

(54) CYLINDRICAL CONDENSER

(75) Inventors: Luciano da Luz Moraes, Canoas (BR); Regis Silva, Sapucaia do Sul (BR); Carlos Afonso Tesche, Canoas (BR); Joao Paulo Pacheco Oliveira, Porto Alegre (BR); Lucio Alende Reffatti, Porto Alegre (BR)

(73) Assignee: Springer Carrier Ltda. (BR)

( * ) Notice: Subject to any disclaimer, the term of this patent is extended or adjusted under 35 U.S.C. 154(b) by 296 days.

(21) Appl. No.: 13/121,795

(22) PCT Filed: Sep. 30, 2008

(86) PCT No.: PCT/BR2008/000297
§ 371 (c)(1),
(2), (4) Date: Mar. 30, 2011

(87) PCT Pub. No.: WO2010/037186
PCT Pub. Date: Apr. 8, 2010

(65) Prior Publication Data
US 2011/0174013 A1 Jul. 21, 2011

(51) Int. Cl.
*F25D 23/12* (2006.01)

(52) U.S. Cl.
USPC ..... 62/259.1; 62/498

(58) Field of Classification Search
USPC ..... 62/259.1, 411, 414, 507
See application file for complete search history.

(56) References Cited

U.S. PATENT DOCUMENTS

| | | | | |
|---|---|---|---|---|
| 2,633,106 | A | 3/1953 | Boarman | |
| 2,642,851 | A | 6/1953 | McFerran | |
| 4,203,302 | A | 5/1980 | Lapeyre | |
| 4,390,059 | A * | 6/1983 | Haas et al. | 165/76 |
| 5,022,828 | A * | 6/1991 | Myers | 417/362 |
| 5,190,496 | A | 3/1993 | Shih-Chin | |
| 5,437,164 | A * | 8/1995 | Consiglio | 62/259.1 |
| 5,765,393 | A | 6/1998 | Shlak et al. | |
| 6,481,233 | B1 * | 11/2002 | Calvert | 62/314 |
| 6,917,756 | B2 | 7/2005 | Henderson et al. | |
| 7,281,387 | B2 * | 10/2007 | Daddis et al. | 62/255 |
| 2003/0192684 | A1 | 10/2003 | Roberts et al. | |
| 2005/0144975 | A1 * | 7/2005 | Fuchikami et al. | 62/508 |
| 2005/0183450 | A1 * | 8/2005 | Kim et al. | 62/507 |
| 2006/0054312 | A1 | 3/2006 | Kim et al. | |
| 2007/0163295 | A1 * | 7/2007 | Martin et al. | 62/507 |
| 2007/0193296 | A1 | 8/2007 | McKenna | |

OTHER PUBLICATIONS

PCT International Preliminary Report on Patentability and Written Opinion of the International Searching Authority for International Application No. PCT/BR/08/00297, Apr. 14, 2011, 9 pages.
PCT International Search Report and Written Opinion of the International Searching Authority for International Application No. PCT/BR 08/00297, Sep. 30, 2008, 15 pages.

* cited by examiner

*Primary Examiner* — Mohammad M Ali
(74) *Attorney, Agent, or Firm* — Cantor Colburn LLP

(57) ABSTRACT

A vertical discharge condenser includes a generally cylindrical heat exchanger having a vertical interruption between a first and a second end of the heat exchanger, a panel enclosing the vertical interruption in the heat exchanger to form an uninterrupted generally cylindrical enclosure, a generally circular fan grille enclosing a top of the cylindrical enclosure, and a generally circular base pan enclosing a bottom of the cylindrical enclosure.

19 Claims, 15 Drawing Sheets

FIG. 6A
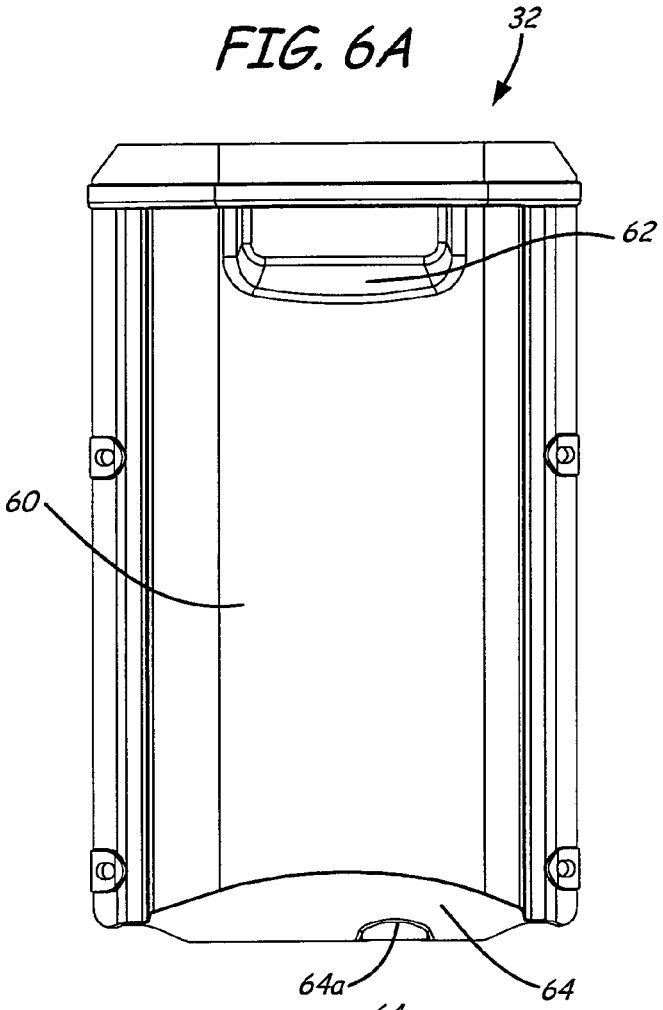
FIG. 6B
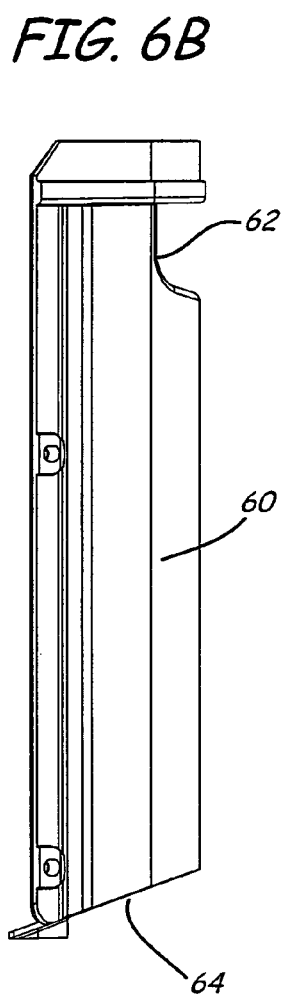
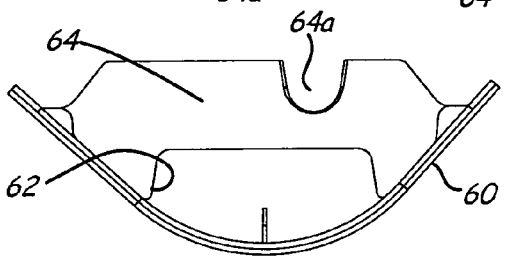
FIG. 6C

FIG. 13A
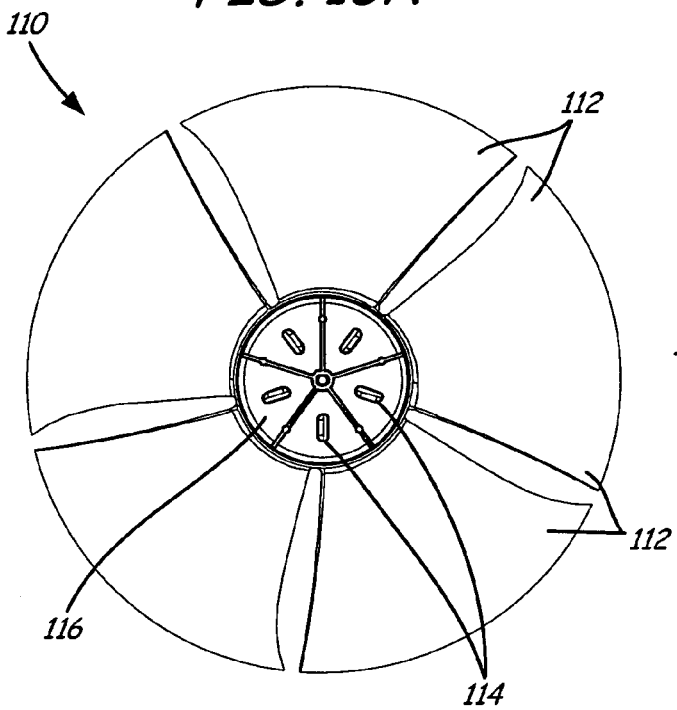
FIG. 13B
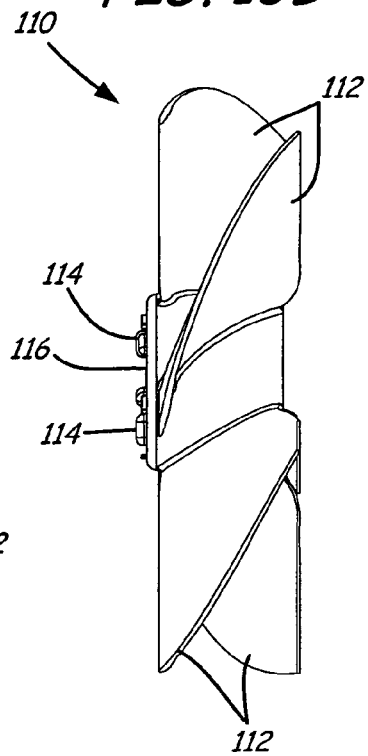
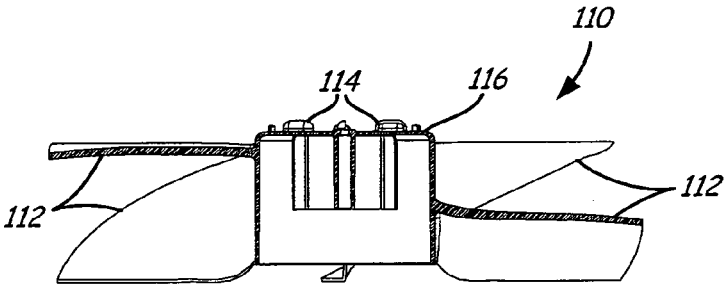
FIG. 13C

FIG. 15A
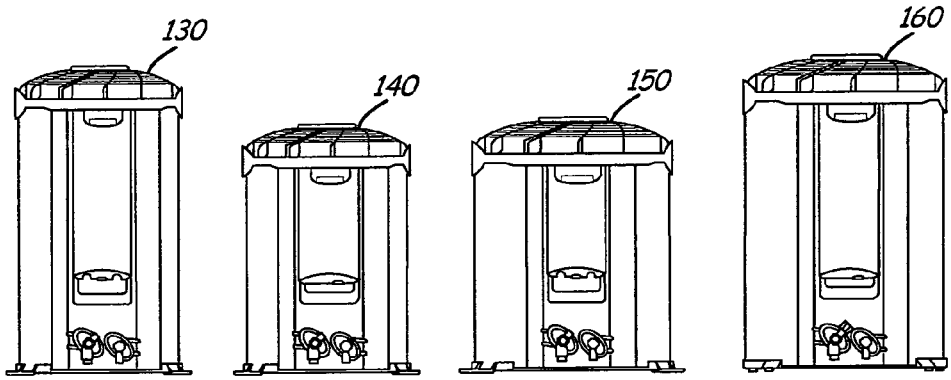
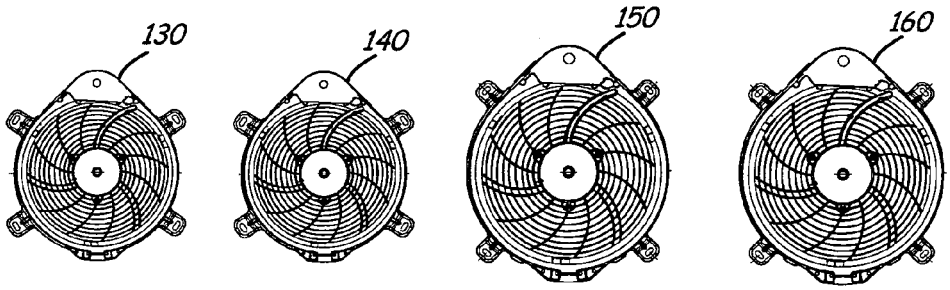
FIG. 15B

CYLINDRICAL CONDENSER

BACKGROUND

This disclosure relates to vapor-compression refrigerant systems used for building heating and air conditioning applications. In particular, this disclosure relates to condensers included in such refrigerant systems.

Air conditioners and heat pumps commonly employ vapor-compression refrigerant systems to cool, or both cool and heat air supplied to a climate controlled comfort zone within, for example, a residence, office building, hospital, school, restaurant or other facility. Conventionally, such vapor-compression systems include a compressor, condenser, an expansion device, and an evaporator connected to one another by refrigerant lines in a closed refrigerant circuit and arranged according to the vapor-compression cycle employed (i.e. heating or cooling). A split heating and/or cooling refrigerant system includes an outdoor unit, such as a condensing unit, and an indoor unit such as an evaporator unit. The condensing unit typically includes protective covering, a fan grille, fan, and motor, a heat exchanger including a number of coils, and a base pan for containing the condensing unit and receiving condensation that drips from the heat exchanger coils. In split systems, the condensing unit also may house the compressor and may be configured for vertical or horizontal discharge.

Split system condensers are configured in a variety of sizes and shapes. For example, horizontal discharge condensers are commonly configured as a box shaped assembly that varies in size depending on the requirements of a particular installation. Size, part count, weight, and installation footprint is a continuing challenge in condenser design. Although improvements have been made in condenser design, a need still exists for lighter and less expensive condensers capable of comparable capacities with greater efficiency and smaller and more flexible installation footprints.

SUMMARY

A vertical discharge condenser includes a generally cylindrical heat exchanger having a vertical interruption between a first and a second end of the heat exchanger, a panel enclosing the vertical interruption in the heat exchanger to form an uninterrupted generally cylindrical enclosure, a generally circular fan grille enclosing a top of the cylindrical enclosure, and a generally circular base pan enclosing a bottom of the cylindrical enclosure.

BRIEF DESCRIPTION OF THE DRAWINGS

FIGS. 6A-6C are orthogonal views of a control box cover employed in the condenser of FIG. 3.

FIGS. 13A-13C are orthogonal views of an alternative fan that may be employed in condensers according to this disclosure.

FIGS. 15A and 15B are side and top views of four size variations of the condenser of FIG. 3 employing the two different sized components shown in FIGS. 14A-14D.

DETAILED DESCRIPTION

Figure 1:
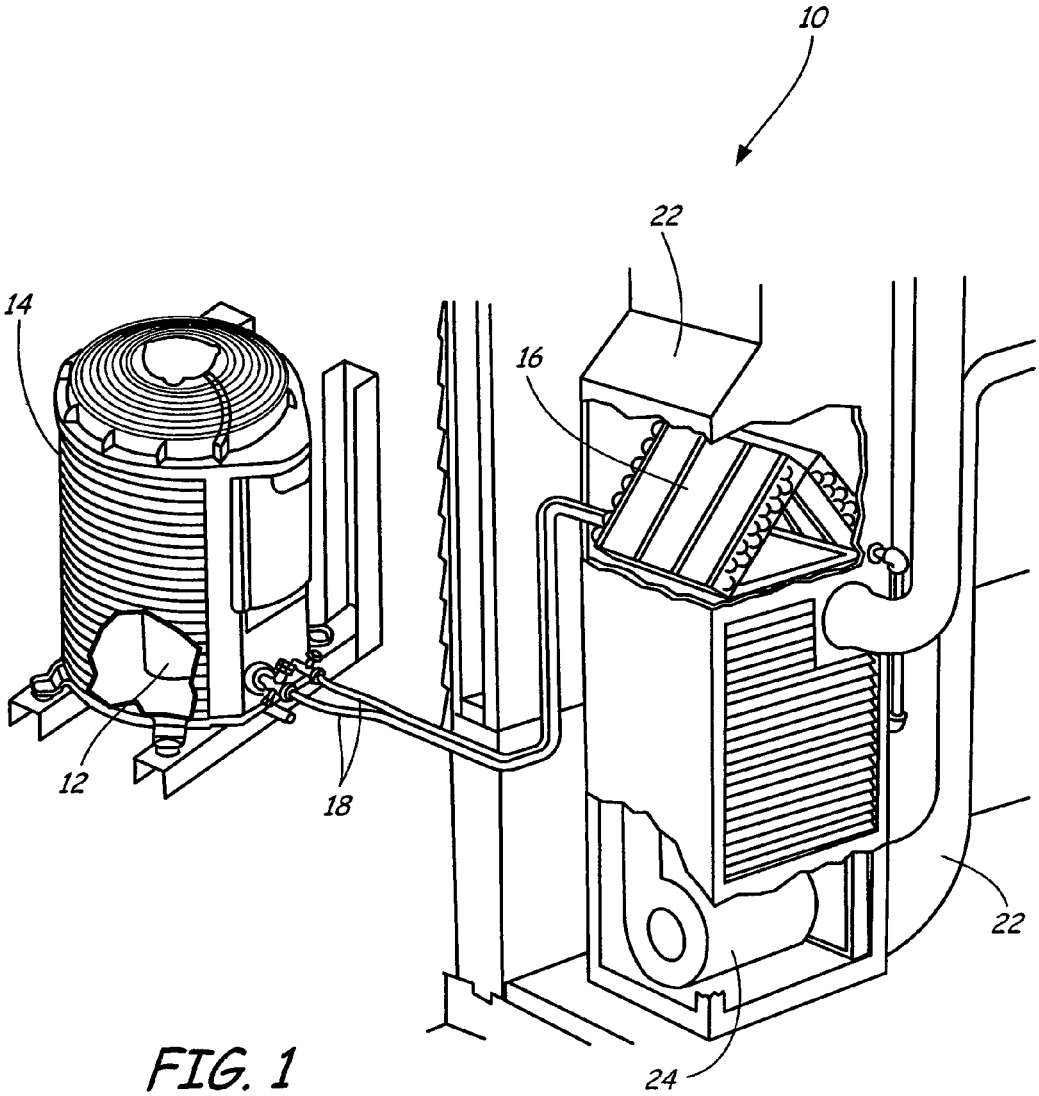
FIG. 1 illustrates a refrigerant system including a condenser according to this disclosure.
Figure 2:
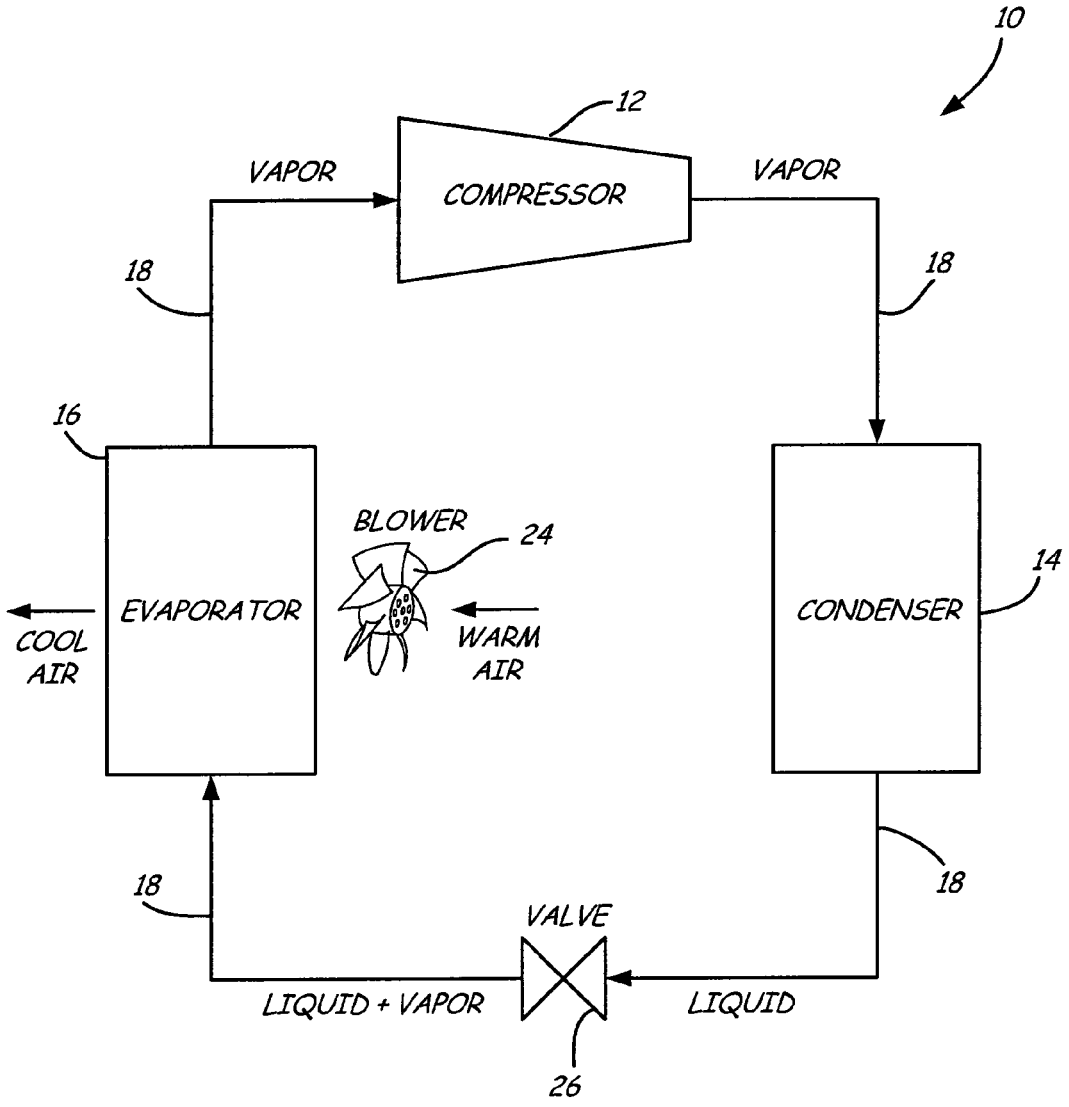
FIG. 2 is a schematic illustrating operation of the refrigerant system of FIG. 1.

FIG. 1 illustrates split refrigerant system 10 including compressor 12, cylindrical condenser 14, and evaporator 16. Embodiments disclosed herein may be employed in various refrigerant systems including, for example, air conditioning or heat pump systems. System 10 is shown to facilitate description of exemplary embodiments of this disclosure and is not intended to limit the scope of the invention set forth in the claims that follow. In FIG. 1, condenser 14 is arranged outside of the building and evaporator 16 is arranged inside the building. Condenser 14 houses compressor 12. Condenser 14 is connected to evaporator 16 by coolant conduits 18. Although not specifically shown in FIG. 1, control systems included in condenser 14 and evaporator 16 may also be electrically connected to facilitate control management between the exterior and interior components of system 10. Compressor 12 may be similarly connected to condenser 14 by coolant conduits. In addition to evaporator 16, system 10 may include closed loop ducts 22 and blower 24 located inside the building. Blower 24 draws air from a return duct and blows the air across evaporator 16 to cool or heat the air before it is circulated through ducts 22 to cool or heat the building. FIG. 2 describes the operation of system 10 in greater detail.

FIG. 2 is a schematic illustrating operation of refrigerant system 10 including compressor 12, condenser 14, evaporator 16, and valve 26. In FIG. 2, refrigerant system 10 is a closed loop system through which refrigerant is cycled in various states, such as liquid and vapor. As a somewhat arbitrary starting point in refrigerant system 10, a low temperature, low pressure superheated gas refrigerant is drawn into compressor 12 through conduit 18, such as a steel pipe, or other conduit from evaporator 16. Compressor 12 is driven by a motor and may be, for example, a rotary screw compressor, or, alternatively, a centrifugal or scroll compressor. Refrigerant is drawn into compressor 12, compressed, and discharged as high temperature, high pressure superheated gas through conduit 18 to condenser 14. System 10 may also include an oil separator (not shown) between compressor 12 and condenser 14, which separates compressor lubricant from the refrigerant before delivering the refrigerant to condenser 14. In condenser 14, the gaseous refrigerant condenses into liquid as it gives up heat. The superheated gas refrigerant enters condenser 14 and is de-superheated, condensed, and sub-cooled through a heat exchange process with, for example, air drawn across heat exchanger coils (through which the refrigerant flows) by a fan to absorb heat. The liquid refrigerant is discharged from condenser 14 to expansion valve 26, which may convert the higher temperature, high pressure sub-cooled liquid to a low temperature saturated liquid-vapor mixture. The low temperature saturated liquid-vapor refrigerant mixture enters evaporator 16 from valve 26 through conduit 18. The low pressure environment in evaporator 16 causes the refrigerant to change states to a superheated gas and absorbs the required heat of vaporization from, for example, air, thus reducing the temperature of the air. The low pressure superheated gas is then drawn into the inlet of compressor 12 and the cycle is continually repeated. The chilled air is then circulated through a distribution system for providing air conditioning, or for other purposes.

Figure 3:
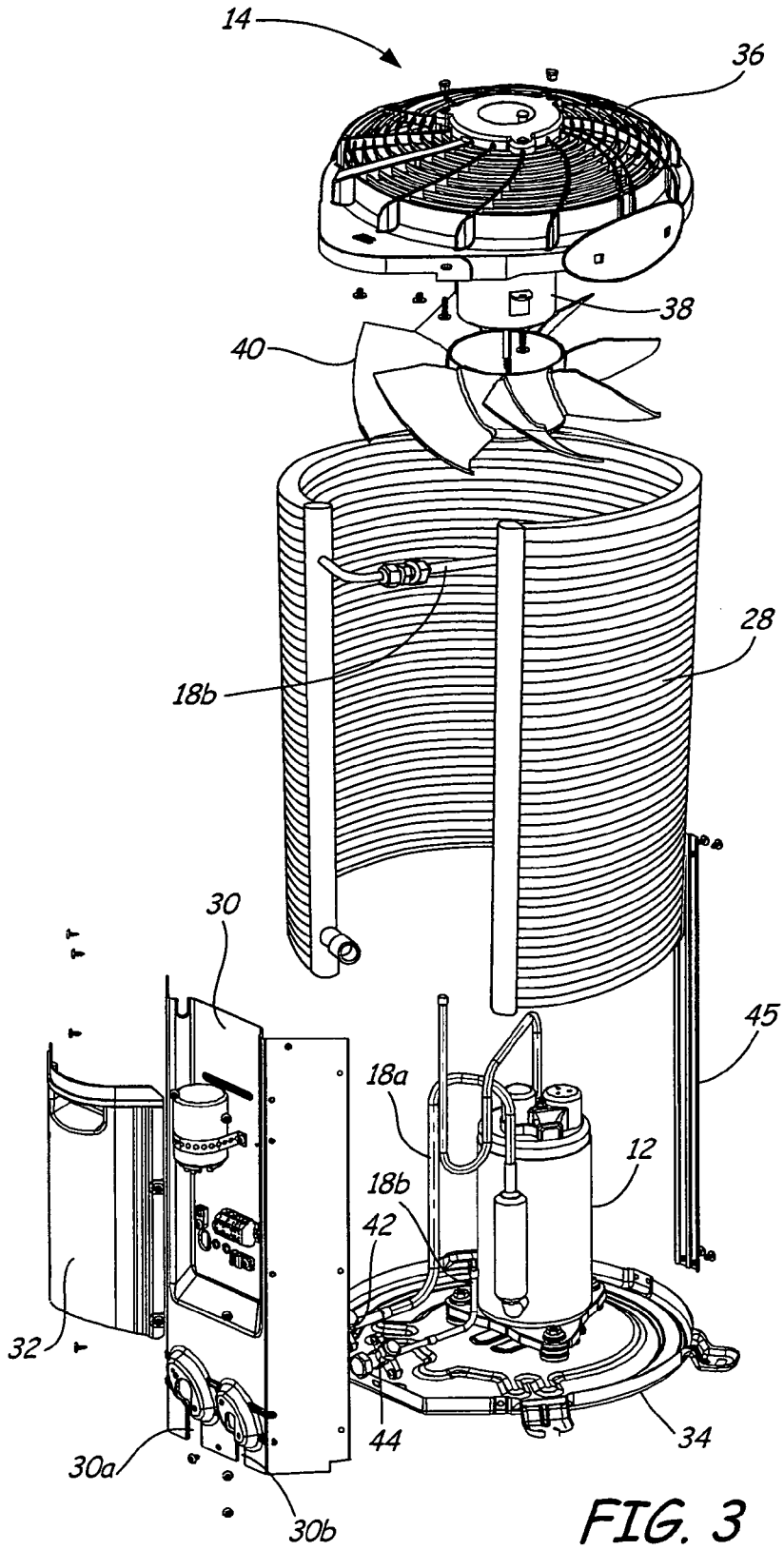
FIG. 3 is a perspective exploded view of the condenser included in the system of FIG. 1.

FIG. 3 is a perspective exploded view of condenser 14 including heat exchanger 28, panel 30, control box cover 32, base pan 34, fan grille 36, motor 38, and fan 40. In FIG. 3, heat exchanger 28 is connected to panel 30 to form a generally cylindrical vertical enclosure. Condenser 14 does not necessitate additional coverings, such as a cover panel enclosing heat exchanger 28. Control box cover 32 is attached to panel 30 to cover electrical components attached to panel 30. Base pan 34 receives the bottom of heat exchanger 28 and panel 30 to form the bottom of condenser 14. Fan grille 36 is connected to motor 38 and motor 38 is operatively connected to fan 40 opposite fan grille 36. Fan grille 36 receives the top of heat exchanger 28 and panel 30 to form the top of condenser 14. Compressor 12 is arranged toward a center of the bottom of condenser 14 on top of base pan 34. Inlet conduit 18*a* is connected to compressor 12 and inlet valve 42. Valve 42 is configured to be connected to conduit carrying evaporated refrigerant from an evaporator arranged inside a building to the compressor. Compressor 12 is connected to heat exchanger 28 by coolant conduit 18, which carries high pressure gas refrigerant from compressor 12 to heat exchanger 28. Outlet conduit 18*b* is connected to heat exchanger 28 and outlet valve 44. Valve 44 is configured to be connected to conduit 18*b* carrying condensed liquid refrigerant from heat exchanger 28 of condenser 14 to the evaporator arranged inside the building. Panel 30 includes slots 30*a*, 30*b* to accommodate inlet and outlet conduits 18*a*, 18*b* passing through panel 30 to connect with valves 42, 44. Condenser 14 may also include additional structural support, such as support bracket 45 connected between base pan 34 and fan grille 36 generally opposite panel 30.

In the case condenser 14 is used as a part of an air conditioning system, fan 40 draws air from outside condenser 14 across heat exchanger 28 and exhausts the air through fan grille 36. Refrigerant from compressor 12 is enclosed in coils in heat exchanger 28. As the refrigerant passes through coils in heat exchanger 28 and the relatively cooler air from outside condenser 14 passes across heat exchanger 28, the air absorbs heat from refrigerant in heat exchanger 28, which causes the refrigerant to condense. The resulting liquid refrigerant then flows through outlet conduit 18*b* and outlet valve 44 to an evaporator inside the building, which uses the refrigerant to cool air. Condenser 14 may also be employed as a part of a heat pump system, in which case heat exchanger 28 acts as an evaporator to extract heat from the surrounding outside air.

As will be discussed in greater detail with reference to specific components, the cylindrical shape and multi-function component design of condenser 14 provides substantial space and cost savings, and installation flexibility without sacrificing the efficiency or the capacity of condenser 14.

Micro-Channel Heat Exchanger

Figure 4A:
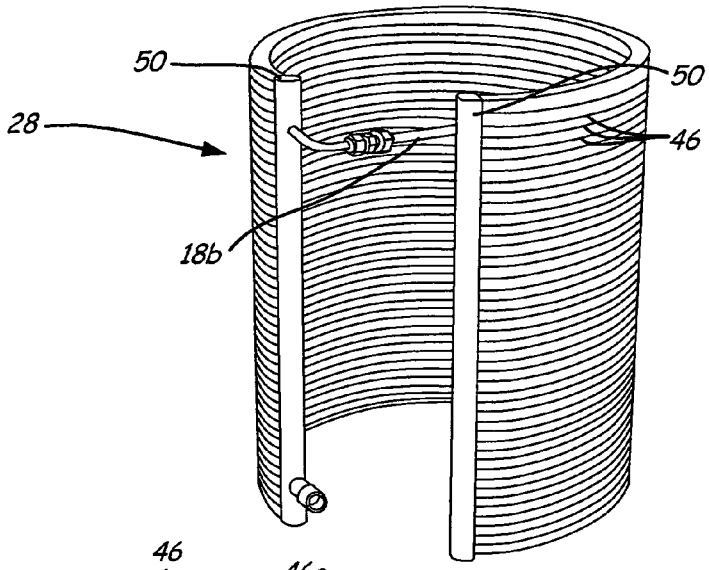
FIG. 4A is a perspective view of a heat exchanger employed in the condenser of FIG. 3.

FIG. 4A is a perspective view of heat exchanger 28 employed in condenser 14 and including coils 46, fins 48, and manifolds 50. In FIG. 4A, coils 46 are stacked vertically in generally parallel relationship to one another and are connected between two manifolds 50. Manifolds 50, sometimes referred to as headers, are closed ended cylinders configured as inlet and outlet paths for refrigerant flowing to and from coils 46. Alternative embodiments may employ close ended tubular manifolds of other shapes, for example, rectangular. Pairs of adjacent coils 46 are connected by a plurality of fins 48 distributed longitudinally between the coils 46. Fins 48 structurally join coils 46, as well as direct air across coils 46 and facilitate heat transfer from coils 46 to the outside air passing over coils 46.

Figure 4B:
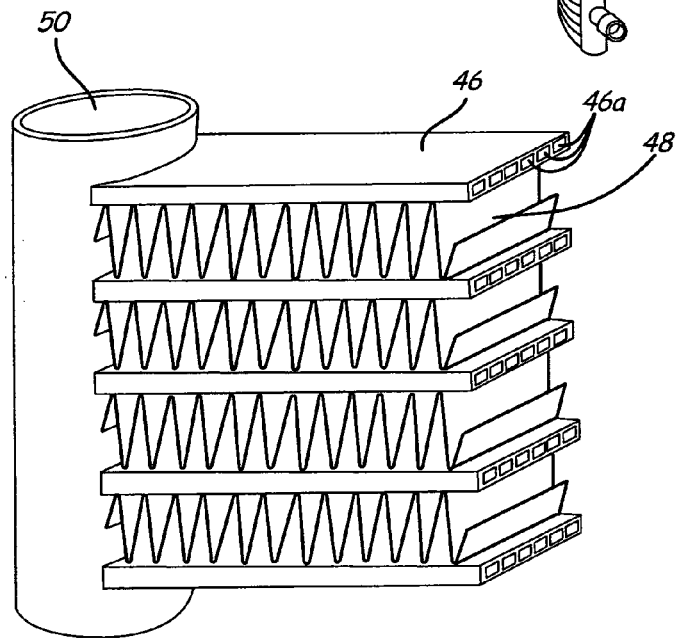
FIGS. 4B and 4C are detail views showing micro-channel coils employed in the heat exchanger of FIG. 4A.
Figure 4C:
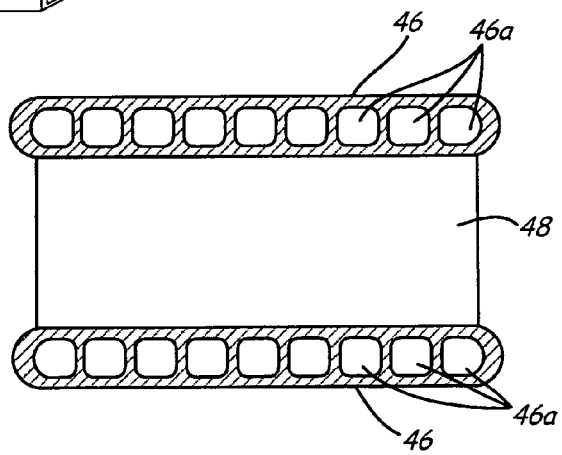

As can be seen from the detail section view of FIG. 4B, each of coils 46 includes multiple channels 46*a*, sometimes referred to as micro-channels, through which refrigerant may flow. Channels 46*a* extend longitudinally in generally parallel relationship between manifolds 50 within coils 46. Channels 46*a* may have different cross-sectional shapes including, for example, rectangular, circular, or oval. Each channel 46*a* provides a small cross-sectional area refrigerant flow path. Employing multi-channel coils, such as coils 46 shown in FIGS. 4A and 4B, significantly increases the total surface area across which refrigerant flows in heat exchanger 28, which in turn acts to increase the capacity and the efficiency of condenser 14. Because of the inherent surface area gain with multi-channel coils, a condenser employing such coils will exhibit greater efficiency and capacity than a condenser with a similarly sized conventional single channel coil heat exchanger. Therefore, multi-channel coils not only yield performance benefits, but also potentially act to reduce the size and weight of the condenser. Coils 46 may be fabricated from, for example, aluminum. Although heat exchanger 28 includes multi-channel coils 46, alternative embodiments may include a heat exchanger employing conventional single channel copper coils.

Heat exchanger 28 is formed as a vertically interrupted cylinder, which constitutes a substantial majority of the vertical exterior enclosure of condenser 14. Heat exchanger 28 thereby additionally acts as a packaging and structural component in condenser 14. The combination of the efficiency and capacity gains of micro-channel technology, and the packaging efficiency and installation flexibility of cylindrically shaped heat exchangers may act to reduce the size of heat exchanger 28 without sacrificing capacity. Additionally, employing heat exchanger 28 as a structural enclosure of condenser 14 reduces part count, weight, and costs of condenser 14 by, for example, eliminating the need for additional sheet metal cover panels.

In certain applications of refrigerant vapor compression systems, for example, residential air conditioning systems, the parallel tube heat exchanger is required to fit into a particularly-sized housing to minimize the air conditioning system footprint. In other applications, the parallel tube heat exchanger is required to fit into an airflow duct of a particular size. In such instances including the interrupted cylindrical heat exchanger 28 employed in condenser 14, it may be necessary to bend or shape the parallel tube heat exchanger to accommodate these special restrictions while ensuring an undiminished ability to cool or heat the climate controlled zone. For example, heat exchanger 28 may be fabricated by bending the assembly around a cylinder. During this process, force is applied to one side of the assembly to wrap it around a partial turn of the cylinder to provide a uniform and reproducible method of bending the assembly. Manifolds 50 remain unmodified during this bending process, as they are oriented longitudinally with respect to a bending axis. Heat exchanger 28 is therefore not susceptible to one drawback of such bending operations, whereby the relatively large and stiff manifolds are crimped or otherwise damaged during bending.

Multi-functional Panel Enclosure and Control Box Cover

Figure 5A:
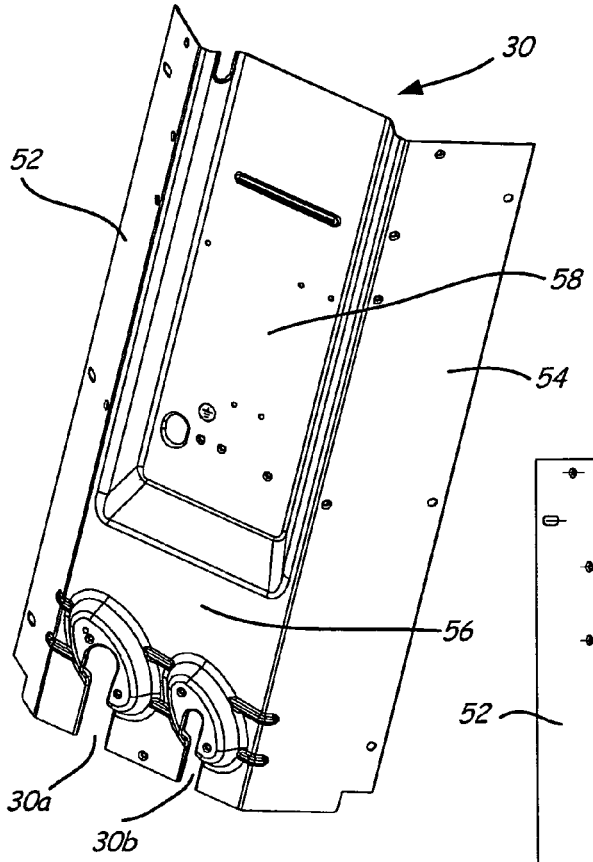
FIGS. 5A-5C show a panel employed in the condenser of FIG. 3.
Figure 5B:
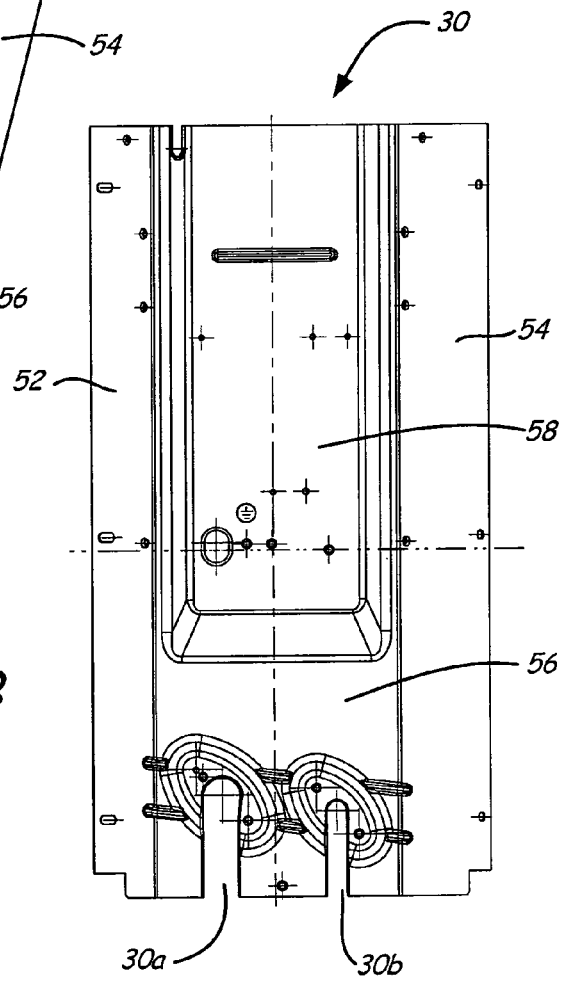
Figure 5C:
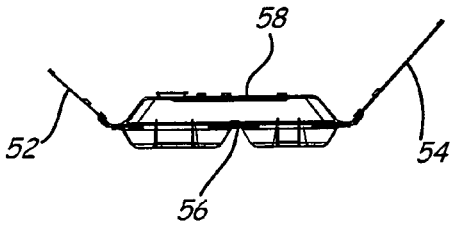
Figure 7A:
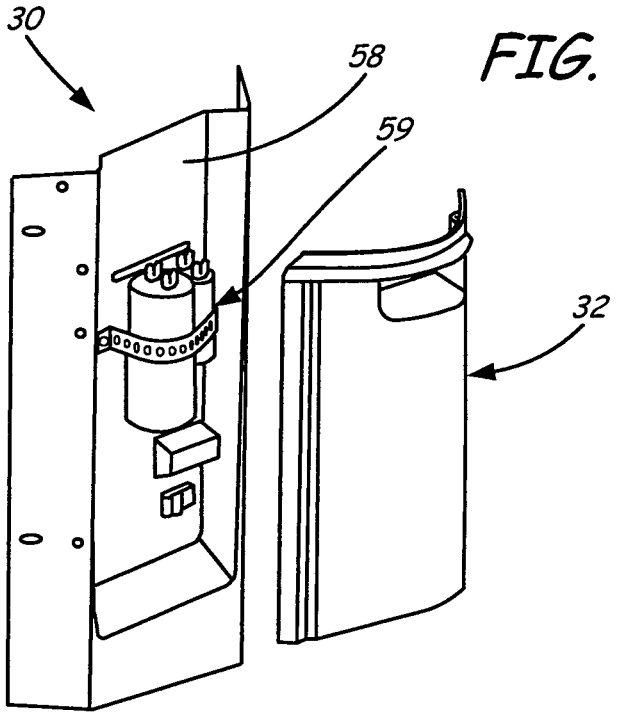
FIGS. 7A and 7B are perspective views illustrating the assembly of the panel of FIGS. 5A-5C and the cover of FIGS. 6A-6C to the condenser of FIG. 3.
Figure 7B:
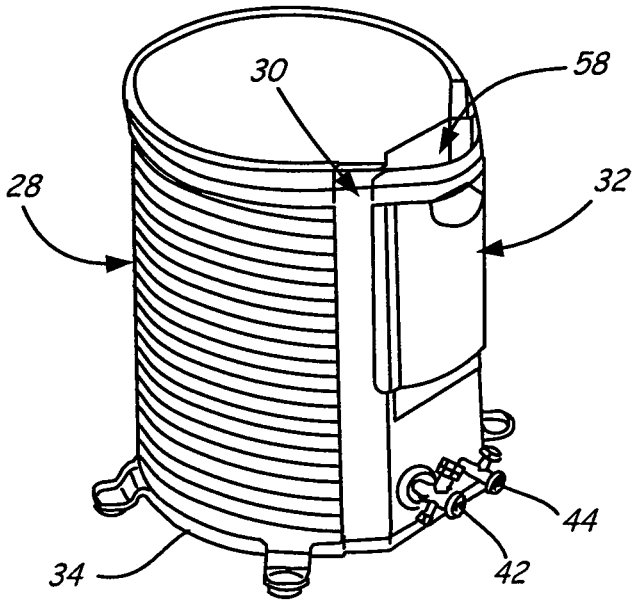

FIGS. 5A-5C show panel 30 employed in condenser 14 and including first leg 52, second leg 54, third leg 56, depression 58, and slots 30*a*, 30*b*. FIGS. 6A-6C are orthogonal views of control box cover 32 including shell 60, handle 62, and bottom enclosure 64. FIGS. 7A and 7B are perspective views illustrating the assembly of panel 30 and cover 32 to heat exchanger 28 and base pan 34.

In FIGS. 5A-5C, 7A and 7B, first and second legs 52, 54 of panel 30 are configured to connect to a first and a second end of heat exchanger 28 defining the vertical interruption in heat exchanger 28. Third leg 56 connects first leg 52 to second leg 54, thereby enclosing the vertical interruption in heat exchanger 28 to form an uninterrupted generally cylindrical enclosure. Although first, second, and third legs 52, 54, 56 are generally planar, alternative embodiments may include a panel enclosure with, for example, curved or arcuate legs or a combination of planar and curved or arcuate legs. For example, an alternative panel may include first and second planar legs connected by an arcuate third leg. Depression 58 is formed in an upper portion of panel 30 and is configured to house electrical components 59 connected to condenser 14 including, for example, termination blocks and a condenser controller. As discussed with reference to FIG. 3, slots 30*a*, 30*b* accommodate inlet and outlet conduits 18*a*, 18*b* passing through panel 30 to connect with inlet and outlet valves 42, 44. Because panel 30 provides structural support for condenser 14 it may be fabricated from, for example, sheet metal with sufficient thickness to provide the support required by a particular embodiment. Panel 30 may be manufactured according to known techniques including, for example, using a machine or stamping press to form the contour of panel 30 into a piece of stock sheet metal.

In FIGS. 6A-6C, 7A and 7B, shell 60 of control box cover 32 forms a generally arcuate vertical cover configured to connect to panel 30 over a portion of depression 58. Handle 62 is formed from a depression in shell 60 and is configured for operator removal of cover 32 from condenser 14. Bottom enclosure 64 is configured to be received by depression 58 in panel 30 and may include an aperture 64*a* sized to accommodate electrical connections between electrical components 59 of condenser 14 and, for example, controls for evaporator 16 located inside a building as shown in FIG. 1. Bottom enclosure 64 of cover 32 may be angled, as best shown in FIG. 6B, to facilitate drainage of, for example, water entrapped between cover 32 and panel 30. As can be seen in FIG. 7B, assembling cover 32 to panel 30 forms a control box with vertical and bottom enclosures. As will be discussed with reference to FIGS. 10A-10D below, the top of panel 30 and cover 32 are configured to be received by fan grille 36, which thereby encloses the top of the condenser control box formed by panel 30 and cover 32 to protect electrical components 59 from environmental hazards, such as rain and debris. Control box cover 32 may be fabricated from, for example, a 5V plastic and according to known techniques including, for example, injection molding. Although embodiments according to this disclosure may also include sheet metal control box covers, fabricating the cover from a plastic provides cost and weight savings, and increases corrosion resistance over metal covers.

Base Pan

Figure 8A:
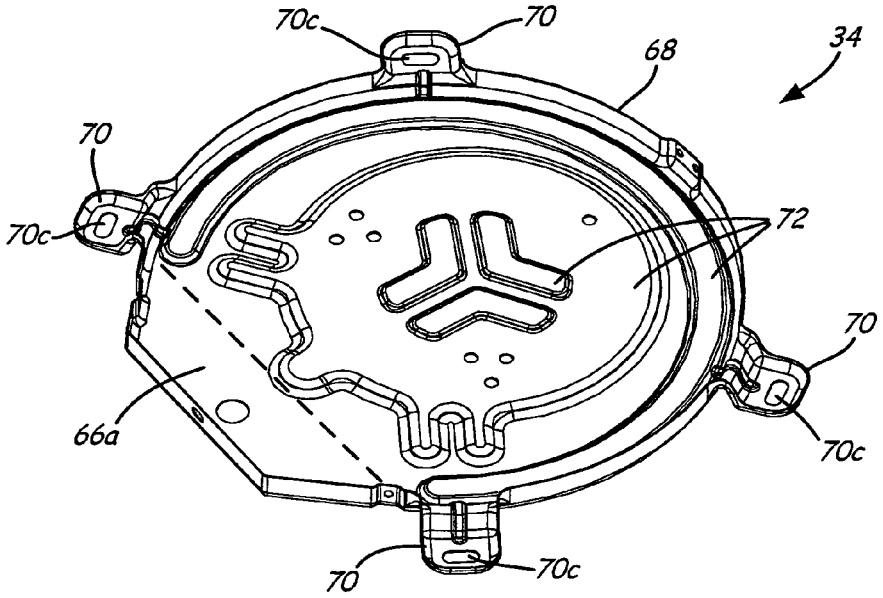
FIGS. 8A and 8B show a base pan employed in the condenser of FIG. 3.
Figure 8B:
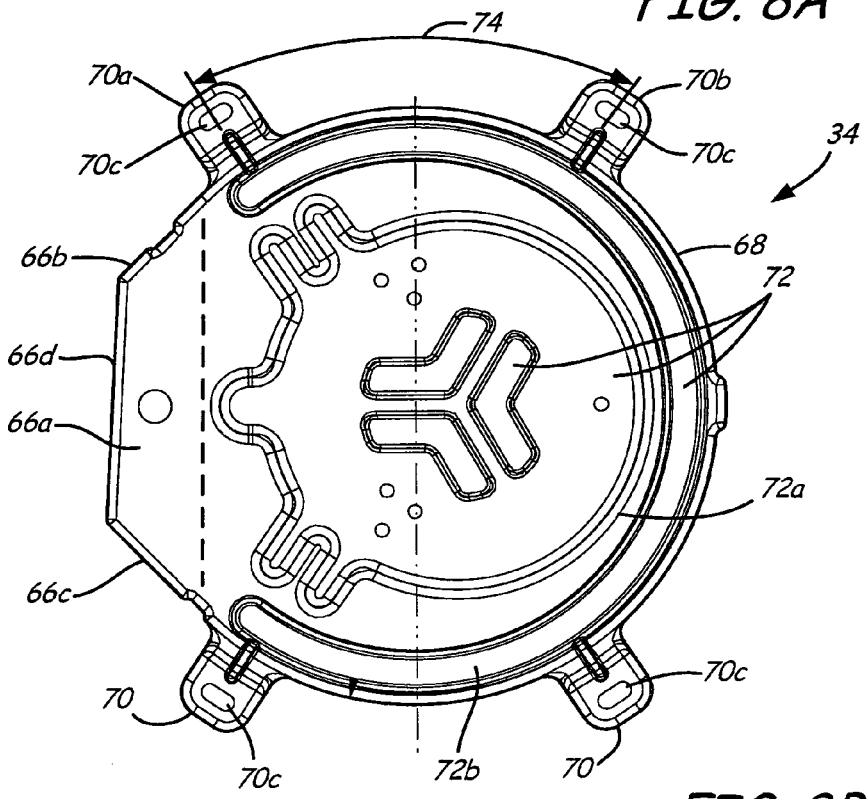

FIGS. 8A and 8B show base pan 34 employed in condenser 14 and including base wall 66, side wall 68, brackets 70, and stiffeners 72. In FIGS. 8A and 8B, base wall 66 is generally circular and may include extension 66*a* protruding radially outward and substantially symmetric about a plane passing through a center of and perpendicular to base wall 66. Extension 66*a* may be shaped with a periphery including first leg 66*b* approximately tangential to a first point on the periphery of base wall 66, second leg 66*c* approximately tangential to a second point on the periphery of base wall 66 opposite the first point about the plane passing through the center of base wall 66, and third leg 66*d* connecting first leg 66*b* to the second leg 66*c*. Base wall 66 including extension 66*a* is thereby configured to receive heat exchanger 28 and panel 30 to form a generally cylindrical enclosure with an open top as shown in FIG. 7B. Side wall 68 projects substantially perpendicular from and along a periphery of base wall 66.

Brackets 70 are integral with and extend radially outward from side wall 68. Brackets 70 are arranged about the center of base pan 34 such that rotating base pan 34 by an approximately 90° increment will cause each of the four brackets 70 to move in a direction of rotation to substantially the same position as an immediately adjacent bracket. For example, in FIG. 8B, bracket 70*a* may be separated from bracket 70*b* by an angle 74 approximately equal to 90°. Rotating base pan 34 by 90° clockwise will therefore cause bracket 70*a* to move into substantially the same position previously occupied by bracket 70*b*. Brackets 70 may also include slots 70*c* for adjustably connecting condenser 14 to the exterior of a building using a support structure including, for example, the angle irons shown in FIG. 1. The arrangement of brackets 70 about the center of base pan 34 increases installation flexibility of condenser 14 by allowing condenser 14 to be connected to a support structure in four different orientations without changing the locations at which condenser 14 is attached to the support.

Figure 9A:
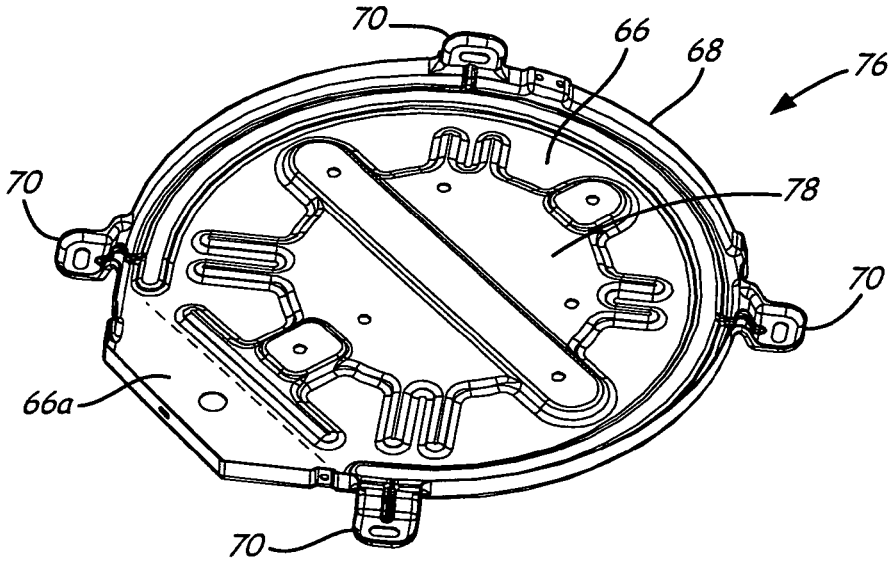
FIGS. 9A and 9B show an alternative base pan that may be employed in condensers according to this disclosure.
Figure 9B:
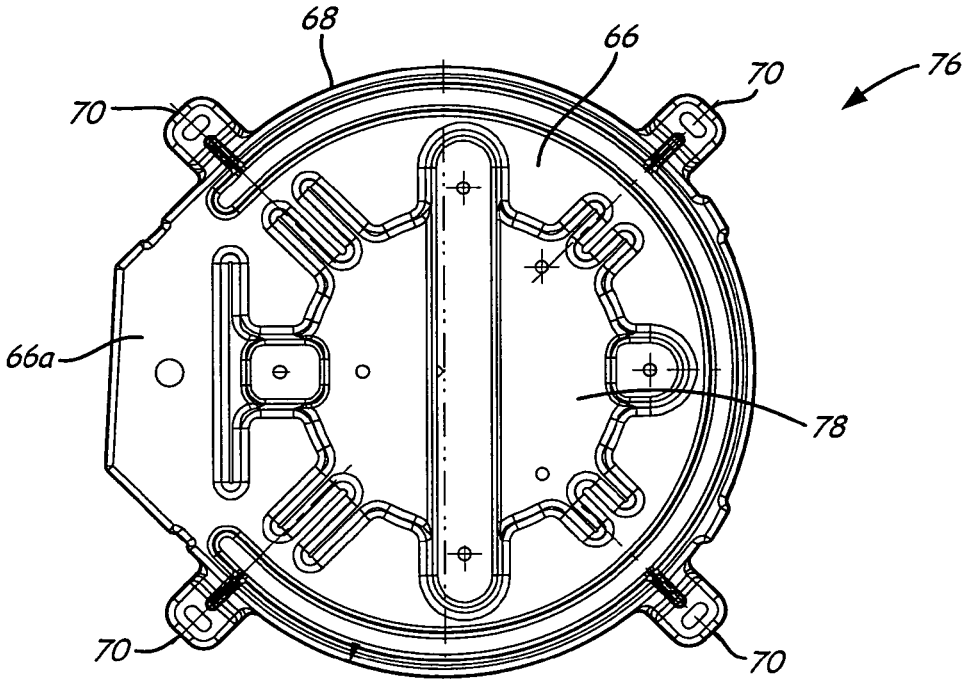

Base pan 34 provides structural support for condenser 14 including supporting compressor 12 mounted toward the center of the bottom of condenser 14 as shown in FIG. 3. To increase the strength without increasing the thickness of base pan 34, base pan 34 may include stiffeners 72. As shown in FIGS. 8A and 8B, stiffeners 72 may be embossed reliefs in base wall 66. In FIGS. 8A and 8B, stiffeners 72 include first generally circular embossed portion 72*a* and second embossed portion 72*b* spaced radially outward from and at least partially surrounding first embossed portion 72*a*. The exact shape, size, and pattern of stiffeners 72 may be varied in different embodiments. For example, FIGS. 9A and 9B show alternative base pan 76 including stiffener 78. Stiffener 78 may be configured to, for example, support a larger compressor with a different attachment base than compressor 12 mounted on base pan 34 within condenser 14.

Base pans according to this disclosure including integrally formed brackets and embossed stiffeners may be fabricated from a single piece of stock sheet metal using known techniques including, for example, the stamping processes described above with reference to panel 30.

Fan Grille and Fan

Figure 12:
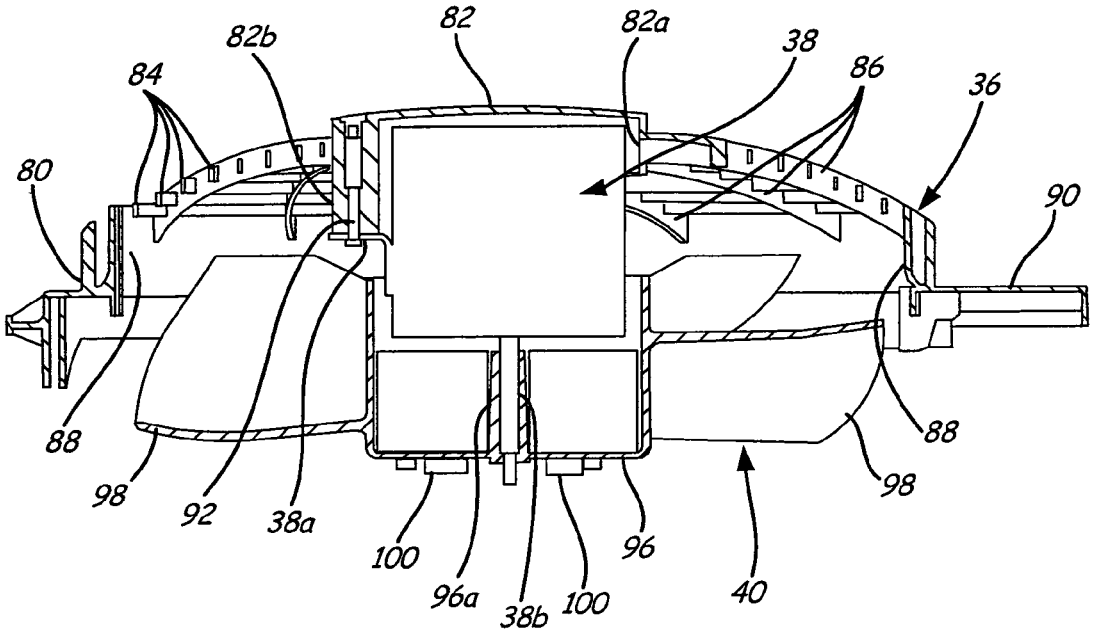
FIG. 12 is a section view showing the fan grille of FIGS. 10A-10D assembled with a fan motor and the fan of FIGS. 11A-11D.
Figure 14A:
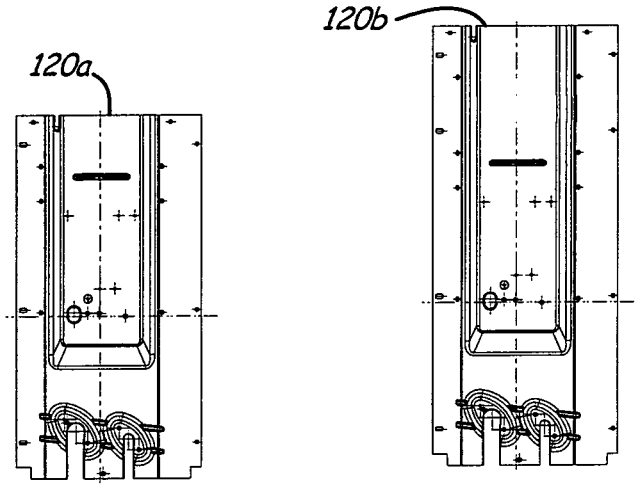
FIGS. 14A-14D are orthogonal views of two different sized panels, control box covers, base pans, and fan grilles.
Figure 14B:
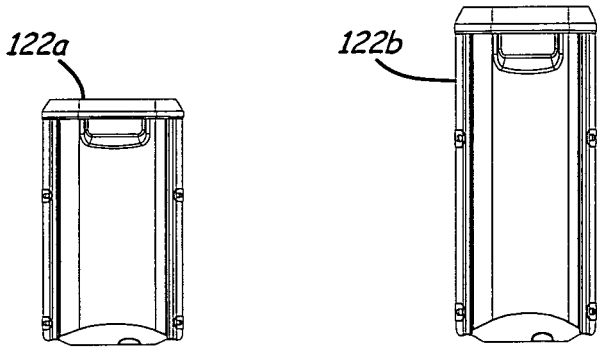
Figure 14C:
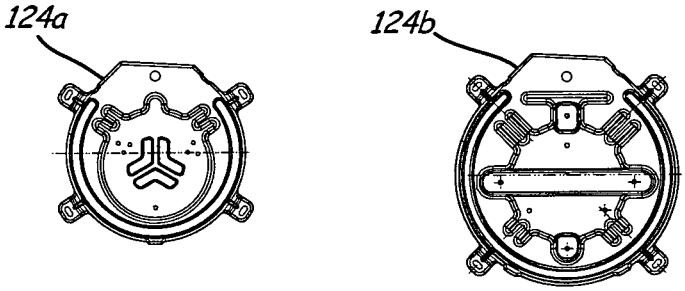
Figure 14D:
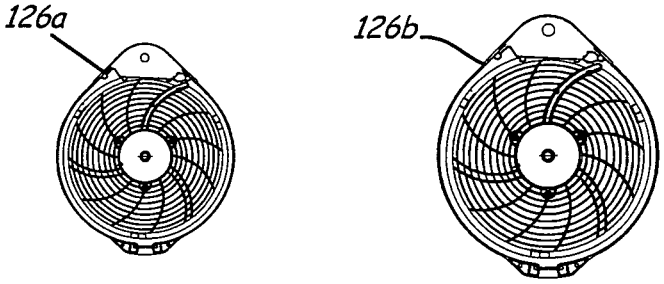

FIGS. 10A-10D are orthogonal views of fan grille 36 employed in condenser 14 and including base 80, hub 82, ribs 84, and airfoils 86. FIGS. 11A-11D fan 40 employed in condenser 14 and including fan hub 96, blades 98, and vents 100. FIG. 12 is a section view showing fan grille 36 assembled with motor 38 and fan 40.

In FIGS. 10A-10D, Base 80 is generally circular and defines a periphery of grille 36. Hub 82 is also generally circular and defines a center portion of grille 36. Ribs 84 are arranged in concentric relationship distributed between base 80 and hub 82. Airfoils 86 connect hub 82 and ribs 84 to base 80 and are configured to direct airflow from within condenser 14 through grille 36.

Base 80 includes first wall 80*a*, second wall 80*b*, and third wall 80*c*. First wall 80*a* forms a substantially flat hoop having a radially inward and radially outward edge. Second wall 80*b* projects substantially perpendicular from the radially outward edge of first wall 80*a* and third wall 80*c* projects substantially perpendicular from the radially inward edge of first wall 80*a* away from second wall 80*b*. Second wall 80*b* may include one or more portions along the radially outward edge of first wall 80*a* that are enlarged in a direction of the second wall (80*b*) projection and in a direction of the third wall (80*c*) projection to form oval shaped plates 80*d* curved along the radially outward edge of first wall 80*a*. Plates 80*d* may be configured for mounting brand, logo, or corporate name plates to fan grille 36. Airfoils 86 project from hub 82 though ribs 84 to intersect with third wall 80*c* of base 80. The radially inward surface of third wall 80*c* forms an orifice 88 configured to direct the airflow from within the condenser through the grille. Incorporating orifice 88 into grille 36 removes the necessity of a separate component acting as an orifice, as is common with prior condensers. Eliminating the separate orifice component reduces part count, weight, and cost of condenser 14.

Base 80 also includes extension 90 protruding radially outward and substantially symmetric about a plane passing through a center of the grille and perpendicular to base 80. Extension 90 is configured to receive the top of panel 30 and control box cover 32 thereby enclosing the top of the control box formed between panel 30 and cover 32 to protect electrical components 59 housed within the control box. As such, extension 90 includes first leg 90*a* substantially tangential to base 80 at a first point on the periphery of base 80, second leg 90*b* substantially tangential to base 80 at a second point on the periphery of base 80 opposite the first point about the plane passing through the center of the grille, and arcuate leg 90*c* connecting first leg 90*a* to second leg 90*b*.

Hub 82 of fan grille 36 forms generally circular pocket 82*a* on the interior side of grille 36. Three semi-cylindrical posts 82*b* are distributed circumferentially around the periphery of pocket 82*a*. Pocket 82*a* and posts 82*b* are configured to receive fan motor 38 as shown in FIG. 12. In FIG. 12, motor 38 includes tabs 38*a* arranged around the periphery of the upper portion of motor 38. Tabs 38*a* are configured to align with posts 82*b* on fan grille 36. Although FIGS. 10A-10D and FIG. 12 show a fan grille with three cylindrical posts and a motor with three tabs, alternative embodiments include fan grilles with a different number of posts and motors with a corresponding number of tabs including, for example, four, five, or more mounting posts and tabs. Motor 38 is attached to grille 36 by fasteners 92 engaging posts 82*b* through tabs 38*a*.

Figure 10A:
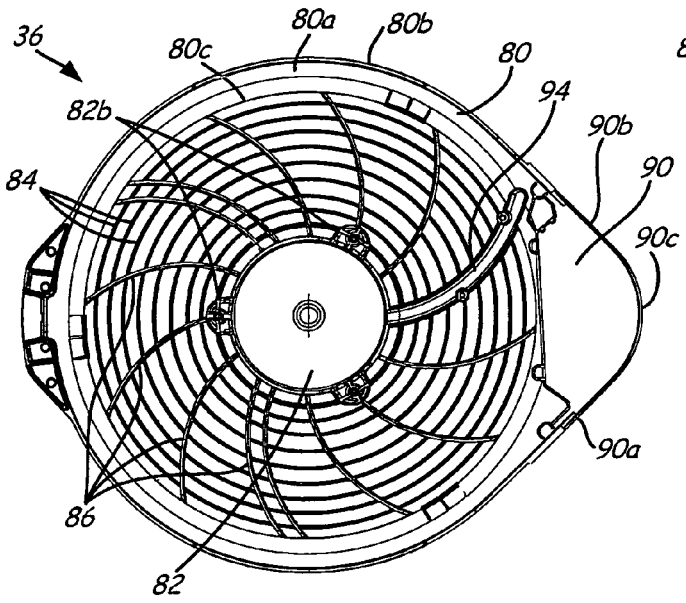
FIGS. 10A-10D are orthogonal views of a fan grille employed in the condenser of FIG. 3.

Ribs 84 are distributed in approximately equidistant increments between hub 82 and base 80 and connected thereto by airfoils 86. Each airfoil 86 projects, with continually increasing curvature from the periphery of hub 82 through third wall 80*c* of base 80. As shown in FIG. 10A, airfoils 86 include three sets of three approximately equally spaced airfoils and two sets of two closely spaced airfoils. Each of the two sets of closely spaced airfoils are interposed between two of the three sets of three approximately equally spaced airfoils. Fan grille 36 also includes channel 94 projecting from the periphery of hub 82 to base 80. Channel 94 is configured substantially similarly to the sets of two closely spaced airfoils with a closed top wall between each of the airfoils. Channel 94 is thereby configured to house and protect electrical wires running from motor 38. Each of the two sets of closely spaced airfoils and channel 94 are distributed in approximately equidistant angular increments about the periphery of hub 82.

Figure 10B:
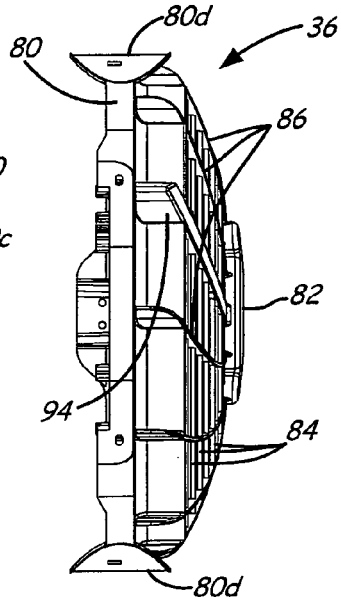
Figure 10C:
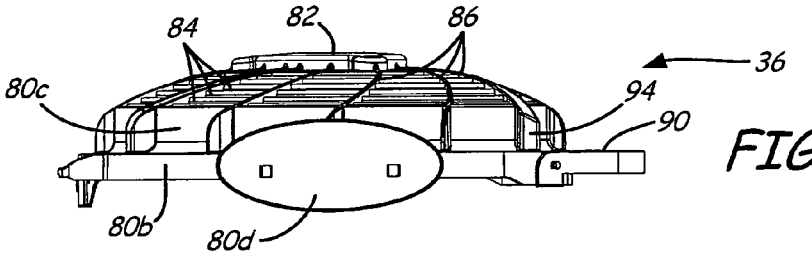
Figure 10D:
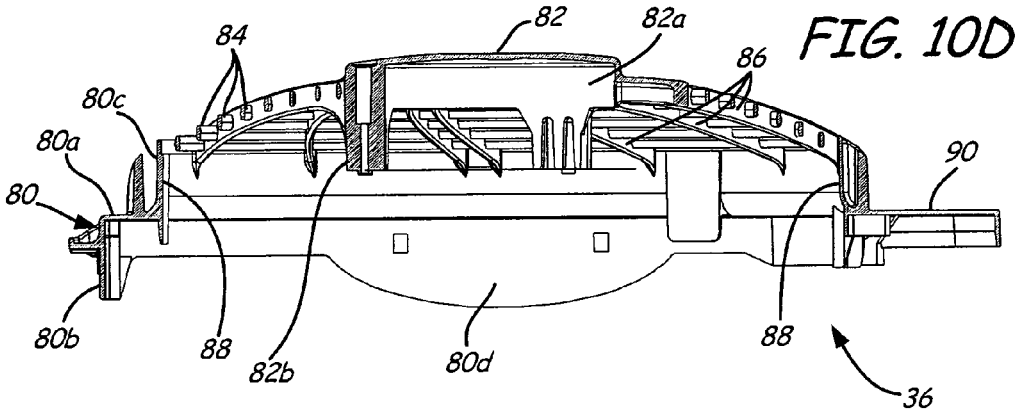
Figure 11A:
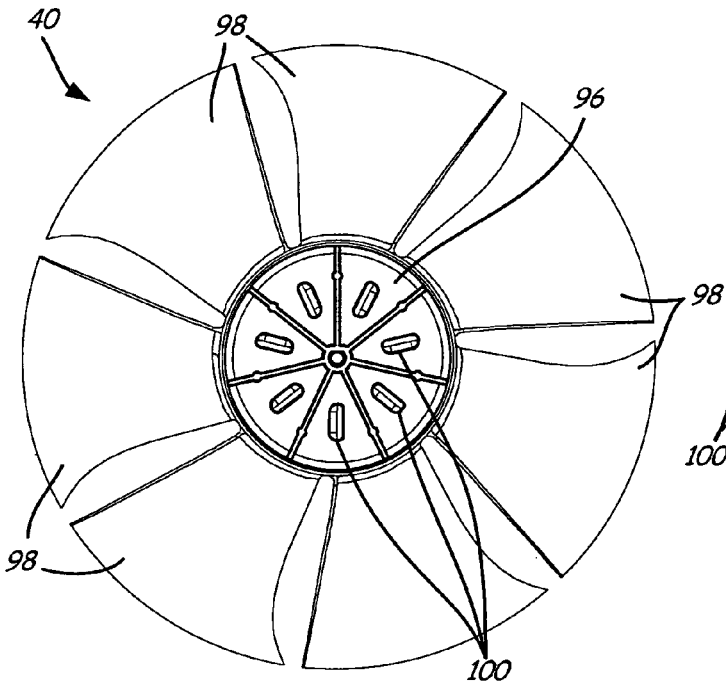
FIGS. 11A-11D show a fan employed in the condenser of FIG. 3.
Figure 11B:
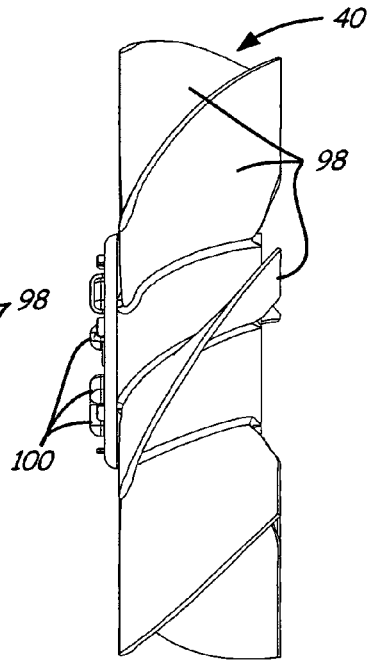
Figure 11C:
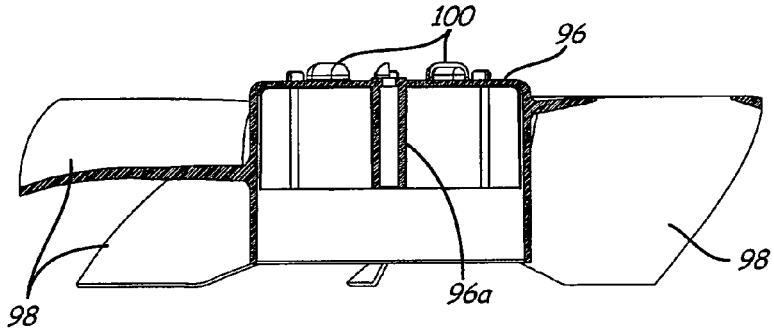
Figure 11D:
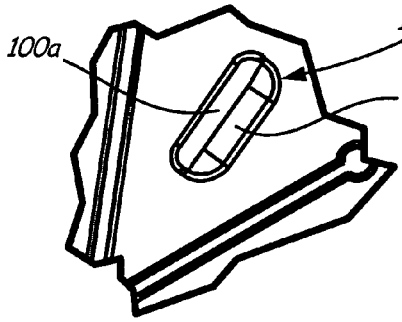

As can be seen from FIGS. 10B-10D, base 80, hub 82, ribs 84, and airfoils 86 form a dome shaped exterior contour of fan grille 36. Prior fan grilles have commonly been fabricated from metal. It has therefore not been practical to incorporate complex design features into such grilles. However, because fan grille 36 may be fabricated from, for example, a 5V plastic according to known techniques including, for example, injection molding, fan grille 36 may include features such as airfoils 86, integral orifice 88, channel 94 and the dome shaped contour formed by base 80, hub 82, ribs 84, and airfoils 86.

In FIGS. 11A-11D, fan hub 96 is a cylinder closed at one end to form the bottom and open at one end to form the top of fan hub 96. Fan hub 96 includes post 96*a* projecting from the center of the bottom toward the top of fan hub 96. Post 96*a* is configured to operatively connect to shaft 38*b* of motor 38 as shown in FIG. 12. Blades 98 are circumferentially distributed about the periphery of fan hub 96. Vents 100 are distributed in a generally circular pattern about a center of the bottom of fan hub 96. As shown in the detail view of FIG. 11D, each vent 100 includes elongated aperture 100*a* arranged radially outward from the center of the bottom of fan hub 96 and scoop 100*b* protruding from approximately half of the periphery of aperture 100*a*.

As shown in FIG. 12, the open top of fan hub 96 extends above a bottom portion of motor 38 from which shaft 38*b* projects toward fan hub 96.

Fan hub 96 may extend above the bottom of motor 38 by, for example, approximately 1 inch (25.4 mm). To decrease costs and weight of condenser 14, fan 40 may be fabricated from plastic including, for example, a 5V plastic by known techniques including injection molding. Although fabricating fan 40 from plastic may save cost and reduce weight, alternative embodiments nevertheless include fans fabricated from different materials including, for example, metals. Nesting the bottom of motor 38 partially within fan hub 96 of fan 40 decreases the height of the fan-motor-grille assembly, which in turn may decrease the overall height of condenser 14. However, because fan 40 may be fabricated from plastic, instead of, for example, metal, motor 38 may require additional cooling to reduce the risk of fan 40 being compromised during operation. Vents 100 are therefore configured to cool motor 38 by directing air captured by scoops 100*b* through apertures 100*a* toward motor 38 as fan 40 rotates. Vents 100 also act to drain liquid entrapped within fan hub 96.

Alternative embodiments according to this disclosure include condenser fans of varying size and with different numbers of blades and vents. For example, FIGS. 13A-13C are orthogonal views of alternative fan 110 that may be employed in condensers according to this disclosure. Fan 110 includes five blades 112 and five vents 114 and may have a different outside diameter, as well as differently sized fan hub 116 than fan hub 96 of fan 40 described above.

Condenser Modularity

Condensers according to this disclosure including, for example, condenser 14, employ a cylindrical vertical discharge design with substantial packaging, cost, and installation benefits over prior designs. Embodiments according to this disclosure accomplish these benefits by a more efficient use of space and by using fewer or single components for multiple functions. For example, the cylindrical shape of condensers according to this disclosure decreases installation footprint without necessarily sacrificing capacity. Additionally, such condensers provide substantially increased installation flexibility by taking advantage of the symmetry of the cylindrical design and incorporating features such as the base pan with integral substantially symmetrical mounting brackets described above. In addition to installation footprint and flexibility benefits, condensers according to this disclosure also reduce part count and weight by combining functions of multiple components into fewer or even a single component. For example, the vertically interrupted cylindrical heat exchanger functions as both a structural component and a substantial portion of the vertical enclosure of the condenser assembly. The multi-functional panel enclosure, along with the control box cover, forms a condenser control box in which all or nearly all of the electrical components may be housed and easily accessed during assembly and maintenance. Similarly, the fan grille acts as a top enclosure and an orifice and the base pan acts as-a mounting bracket for the condenser assembly.

An additional benefit of the reduced part count and multi-function component design of condensers according to the present invention is illustrated in FIGS. 14A-14D, 15A and 15B. FIGS. 14A-14D are orthogonal views of two different sized panels 120*a*, 120*b*, control box covers 122*a*, 122*b*, base pans 124*a*, 124*b*, and fan grilles 126*a*, 126*b* respectively. FIGS. 15A and 15B are side and top views four condensers 130, 140, 150, and 160 employing the components shown in FIGS. 14A-14D. As illustrated in FIGS. 15A and 15B, the modular design of condensers according to the present invention provide four different condenser configurations from only two different sets of four major components. Condensers 130 and 140 combine smaller base pan 124*a* and fan grille 126*a* with larger panel 120*b* and control box cover 122*b* in condenser 130, and smaller panel 120*a* and control box cover 122*a* in condenser 140. Similarly, condensers 150 and 160 combine larger base pan 124*b* and fan grille 126*b* with smaller panel 120*a* and control box cover 122*a* in condenser 150, and larger panel 120*b* and control box cover 122*b* in condenser 160. The vertically interrupted cylindrical heat exchanger must be modified for each of condenser 130, 140, 150, and 160. However, all or nearly all of the remaining components in condensers 130, 140, 150, and 160 may be interchangeable between the four configurations. The modular design of condensers according to this disclosure thereby substantially decreases part count and complexity across multiple configurations, which in turn decreases manufacturing, installation, and maintenance costs.

Although this disclosure is made with reference to exemplary embodiments, workers skilled in the art will recognize that changes may be made in form and detail without departing from the spirit and scope of the invention set forth in the claims that follow.

The invention claimed is:

1. A refrigerant system comprising:

a compressor;

a cylindrical vertical discharge condenser connected to the compressor, the condenser comprising:

a generally cylindrical heat exchanger having a vertical interruption between a first and a second end of the heat exchanger;

a panel enclosing the vertical interruption in the heat exchanger;

a generally circular fan grille receiving a top of the heat exchanger and a top of the panel; and a generally circular base pan receiving a bottom of the heat exchanger and a bottom of the panel;

an expansion valve connected to the condenser; and an evaporator connected to the expansion valve and the compressor;

wherein the heat exchanger comprises a plurality of micro-channel coils stacked vertically in generally parallel relationship to one another.

2. The refrigerant system of claim 1, wherein the panel comprises:

a first portion connected to one of the first end and the second end of the heat exchanger;

a second portion connected to the other of the first end and the second end of the heat exchanger; and a generally planar portion connecting the first portion to the second portion.

3. The refrigerant system of claim 2, wherein the planar portion comprises a depression configured to house one or more electrical components connected to the condenser.

4. The refrigerant system of claim 3 further comprising a generally arcuate cover configured to enclose the one or more electrical components and connected between the first and the second portion over the depression in the planar portion of the panel.

5. The refrigerant system of claim 4, wherein the cover comprises:

an elongated arcuate shell;

a handle formed from a depression in the shell; and a bottom enclosure protruding from a bottom of the shell and configured to be received by the depression in the panel.

6. The refrigerant system of claim 5, wherein the bottom enclosure comprises an aperture configured to accommodate one or more electrical connections running from the condenser to another refrigerant system component.

7. The refrigerant system of claim 4, wherein the generally circular fan grille comprises an extension configured to engage a top of the cover and enclose a space formed between the cover and the depression in the planar portion of the panel in which the one or more electrical components are housed.

8. The refrigerant system of claim 1, wherein the panel comprises a first and a second slot in a bottom of the panel configured to accommodate conduits through which a working fluid passes in and out of the condenser.

9. The refrigerant system of claim 1 wherein the heat exchanger comprises:

a first manifold extending longitudinally with respect to the coils and connected to a first end of each of the coils; and a second manifold extending longitudinally with respect to the coils and connected to a second end of each of the coils;

wherein the coils are C-shaped to form a generally cylindrical heat exchanger having a longitudinal interruption between the first and the second manifolds.

10. The refrigerant system of claim 9, wherein each of the coils comprises a plurality of channels extending longitudinally between the first and the second manifold within the coil.

11. The refrigerant system of claim 9 further comprising a plurality of fins distributed longitudinally and connected between each pair of adjacent coils.

12. The refrigerant system of claim 1 wherein the grille comprises:

a base defining a periphery of the grille;
a hub defining a center portion of the grille;
a plurality of concentric ribs distributed between the hub and the base; and
a plurality of airfoils connecting the hub and the concentric ribs to the base and configured to direct an airflow from within the condenser through the grille.

13. The refrigerant system of claim 1 further comprising:
a motor attached to the grille; and
a fan arranged below the motor, the fan comprising:
a hub operatively connected to a shaft of the motor;
a plurality of blades attached to the hub; and
a plurality of vents in a bottom of the hub configured to direct air toward the motor and drain liquid from the hub.

14. The refrigerant system of claim 13, wherein the hub comprises a cylinder closed at one end to form the bottom of the hub and open at one end to form a top of the hub; and wherein the vents are distributed in a generally circular pattern about a center of the bottom of the hub.

15. A refrigerant system comprising:
a compressor;
a cylindrical vertical discharge condenser connected to the compressor, the condenser comprising:
a generally cylindrical heat exchanger having a vertical interruption between a first and a second end of the heat exchanger;
a panel enclosing the vertical interruption in the heat exchanger;
a generally circular fan grille receiving a top of the heat exchanger and a top of the panel; and
a generally circular base pan receiving a bottom of the heat exchanger and a bottom of the panel;
an expansion valve connected to the condenser;
an evaporator connected to the expansion valve and the compressor;
wherein the heat exchanger comprises:
a plurality of micro-channel coils stacked longitudinally;
a first manifold extending longitudinally with respect to the coils and connected to a first end of each of the coils; and
a second manifold extending longitudinally with respect to the coils and connected to a second end of each of the coils;
wherein the coils are C-shaped to form a generally cylindrical heat exchanger having a longitudinal interruption between the first and the second manifolds;
the base pan comprising:
a generally circular first wall;
a second wall perpendicular from the first wall along a periphery of the first wall; and
a plurality of brackets connected to and extending radially outward from the second wall.

16. The refrigerant system of claim 15, wherein the brackets are arranged such that rotating the base pan by an approximately 90 degrees increment will cause each of the brackets to move in a direction of rotation to substantially the same position as an immediately adjacent bracket.

17. The refrigerant system of claim 15, wherein the first wall comprises an extension protruding radially outward and substantially symmetric about a plane passing through a center of and perpendicular to the first wall, the extension being coplanar with the first wall.

18. The refrigerant system of claim 17, wherein a periphery of the extension comprises:
a first linear portion approximately tangential to the first wall at a first point on a periphery of the first wall;
a second linear portion approximately tangential to the first wall at a second point on the periphery of the first wall opposite the first point about the plane passing through the center of the first wall; and
a third linear portion connecting the first linear portion to the second linear potion.

19. A refrigerant system comprising:
a compressor;
a cylindrical vertical discharge condenser connected to the compressor, the condenser comprising:
a generally cylindrical heat exchanger having a vertical interruption between a first and a second end of the heat exchanger;
a panel enclosing the vertical interruption in the heat exchanger:
a generally circular fan grille receiving a top of the heat exchanger and a top of the panel; and
a generally circular base pan receiving a bottom of the heat exchanger and a bottom of the panel;
wherein the grille comprises:
a base defining periphery of the grille;
a hub defining a center portion of the grille;
a plurality of concentric ribs distributed between the hub and the base; and
a plurality of airfoils connecting the hub and the concentric ribs to the base and configured to direct an airflow from within the condenser through the grille
wherein the airfoils comprise:
three sets of three approximately equally spaced airfoils; and
two sets of two closely spaced airfoils;
wherein each of the two sets of closely spaced airfoils and the channel are interposed between two of the three sets of three approximately equally spaced airfoils; and
wherein each of the two sets of closely spaced airfoils and the channel are distributed in approximately equidistant angular increments about the periphery of the hub.

* * * * *